US011185151B2

(12) United States Patent
Wilk

(10) Patent No.: US 11,185,151 B2
(45) Date of Patent: Nov. 30, 2021

(54) MULTIPLE SURFACE SCRUBBING DEVICE AND METHOD OF USE

(71) Applicant: Kara Wilk, Spring, TX (US)

(72) Inventor: Kara Wilk, Spring, TX (US)

( * ) Notice: Subject to any disclaimer, the term of this patent is extended or adjusted under 35 U.S.C. 154(b) by 0 days.

(21) Appl. No.: 16/244,638

(22) Filed: Jan. 10, 2019

(65) Prior Publication Data

US 2020/0060417 A1 Feb. 27, 2020

Related U.S. Application Data

(60) Provisional application No. 62/722,016, filed on Aug. 23, 2018.

(51) Int. Cl.

| | |
|---|---|
| ***A46B 9/02*** | (2006.01) |
| ***A47L 13/12*** | (2006.01) |
| ***B08B 1/00*** | (2006.01) |

(52) U.S. Cl.

CPC ..... *A46B 9/025* (2013.01); *A47L 13/12* (2013.01); *B08B 1/002* (2013.01)

(58) Field of Classification Search

CPC ..... A46B 9/025; A46B 17/06; A47L 13/18; A47L 13/12

See application file for complete search history.

(56) References Cited

U.S. PATENT DOCUMENTS

| | | | | |
|---|---|---|---|---|
| 1,885,572 | A * | 11/1932 | Wood | A61H 7/00 601/137 |
| 1,979,130 | A * | 10/1934 | Wiley | A41D 19/0055 2/168 |
| D477,690 | S * | 7/2003 | Howell | D29/118 |
| 9,015,895 | B2 * | 4/2015 | Filho | A47L 13/18 15/227 |
| D830,027 | S * | 10/2018 | Zhou | D32/40 |
| 10,349,734 | B2 * | 7/2019 | Xavier | A46B 1/00 |
| 2016/0113386 | A1 * | 4/2016 | Lim | A46B 17/02 134/6 |

* cited by examiner

*Primary Examiner* — Randall E Chin

(74) *Attorney, Agent, or Firm* — Leavitt Eldredge Law Firm

(57) ABSTRACT

A scrubbing device includes a body extending from a first end to a second end; bristle protrusions extending from a bottom surface of the body; and elongated protrusions extending from the bottom surface of the body and forming an angle between each elongated protrusion and the bottom surface; the bristle protrusions and elongated protrusions are used for cleaning.

4 Claims, 4 Drawing Sheets

MULTIPLE SURFACE SCRUBBING DEVICE AND METHOD OF USE

BACKGROUND

1. Field of the Invention

The present invention relates generally to cleaning devices, and more specifically, to a multi surface scrubbing device for cleaning with more than one type of scrubbing structure, thereby improving the functionality of the device.

2. Description of Related Art

Scrubbing devices are well known in the art and aid in cleaning surfaces, such as counter tops. For example, FIG. 1 depicts a conventional sponge 101 having a sponge body 103 and a textured surface 105. During use, the user uses surface 105 to scrub surfaces.

One of the problems commonly associated with system 101 is limited use. For example, the surface 105 is not always suitable for scrubbing various surface and/or removing difficult substances.

Accordingly, although great strides have been made in the area of scrubbing devices, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
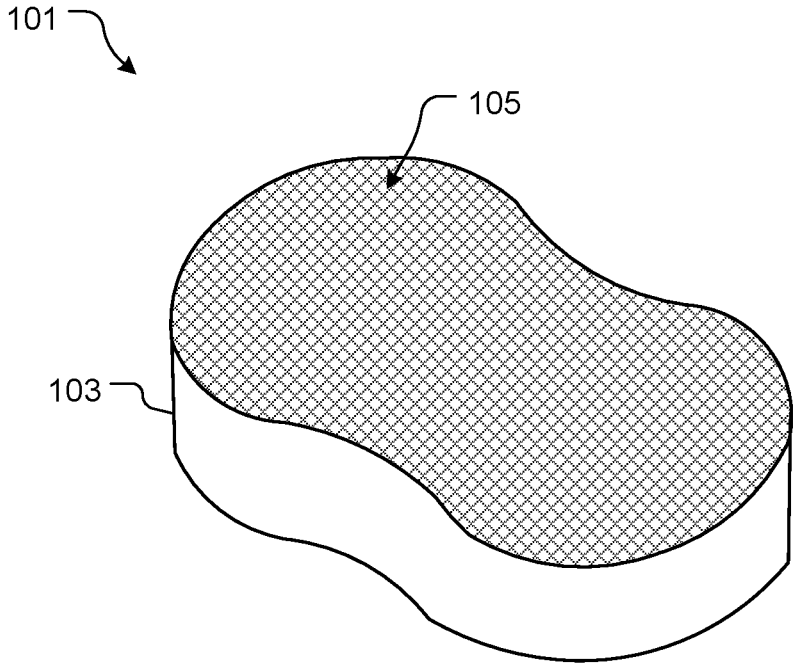
FIG. 1 (Prior Art)
FIG. 1 is an isometric view of a conventional scrubbing device.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional scrubbing devices. Specifically, the present invention provides for a scrubbing device with multiple scrubbing features to provide for varied use of the device and improved cleaning. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
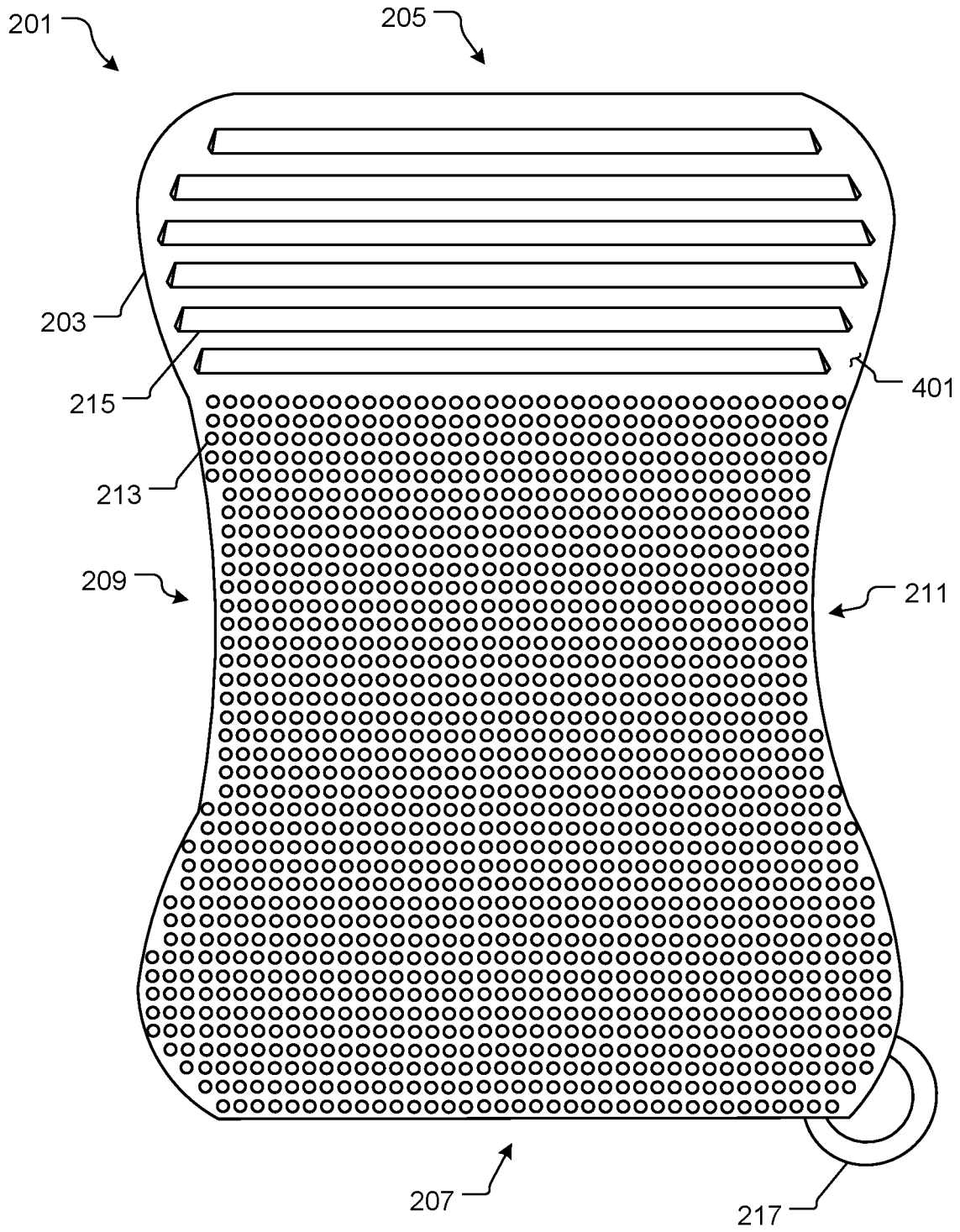
FIG. 2 is a bottom view of a scrubbing device in accordance with a preferred embodiment of the present application.
Figure 3:
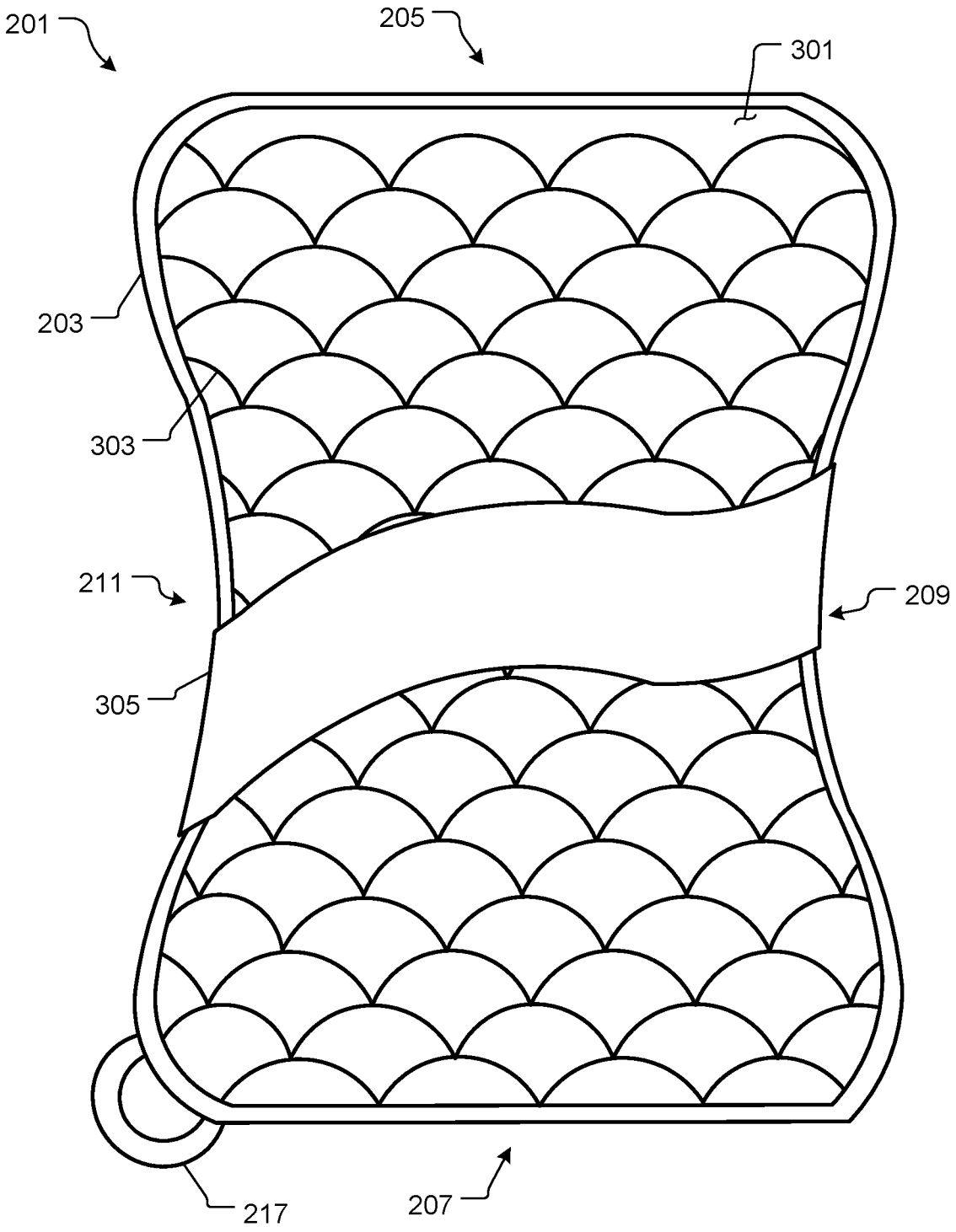
FIG. 3 is a top view of the device of FIG. 2.
Figure 4:
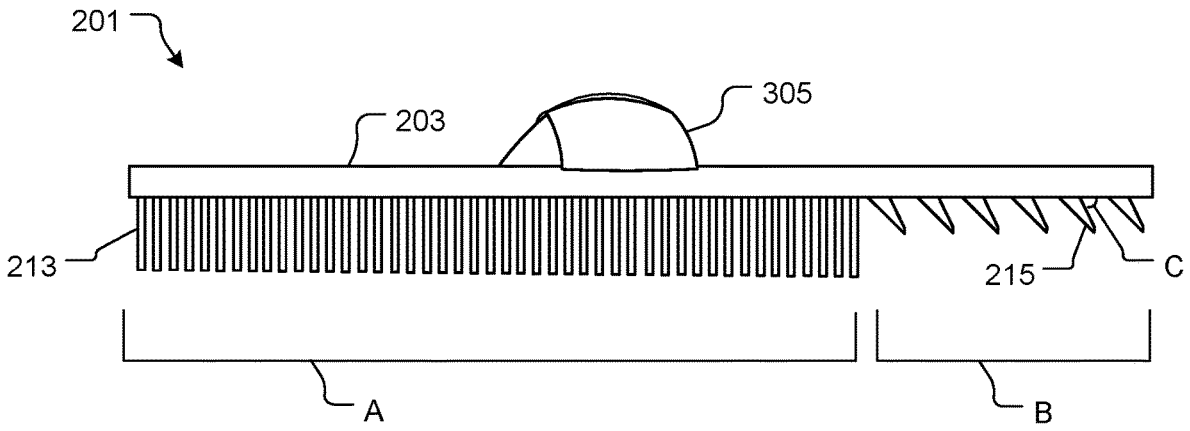
FIG. 4 is a side view of the device of FIG. 2.

Referring now to the drawings wherein like reference characters identify corresponding or similar elements throughout the several views, FIGS. 2-4 depicts various views of a scrubbing device 201 in accordance with a preferred embodiment of the present application. It will be appreciated that device 201 overcomes one or more of the above-listed problems commonly associated with conventional scrubbing devices.

In the contemplated embodiment, device 201 includes a body 203 extending from a first end 205 to a second end 207 and includes curved sides 209, 211, thereby making the device ergonomically suited for the hands of the user. The device 201 includes a first type of protrusion 213 and a second type of protrusion 215. In the preferred embodiment, protrusions 213 are bristle like and protrusions 215 are elongated, angled scrubbers aligned in rows. In the preferred embodiment, the entire device is composed of a silicone or similar material.

It should be appreciated, that as shown, the bristles 213 covers approximately two thirds A of the bottom surface 401, whereas the elongated, angled scrubbers cover approximately one third B. In the preferred embodiment, the protrusions 215 are positioned at a 45 degree angle C from the bottom surface 401, thereby allowing for effective scrubbing via the device.

As shown in FIG. 3, the top surface 301 of device 201 include a fish scale surface treatment 303 which provides for improved grip by the user. Further includes is a handle 305 which is configured to extend over a top of the user's hand to secure the device to the user's hand. In addition, in some embodiments, a ring 217 is attached at a corner of the body, thereby allowing for the device to easily be hung from a hook or the like.

It should be appreciated that one of the unique features believed characteristic of the present application is the use of two types of scrubbing features (the bristles and the elongated scrubbers) on the same surface, this allows for the user to use the elongated scrubbers to remove difficult substances from surface.

Figure 5:
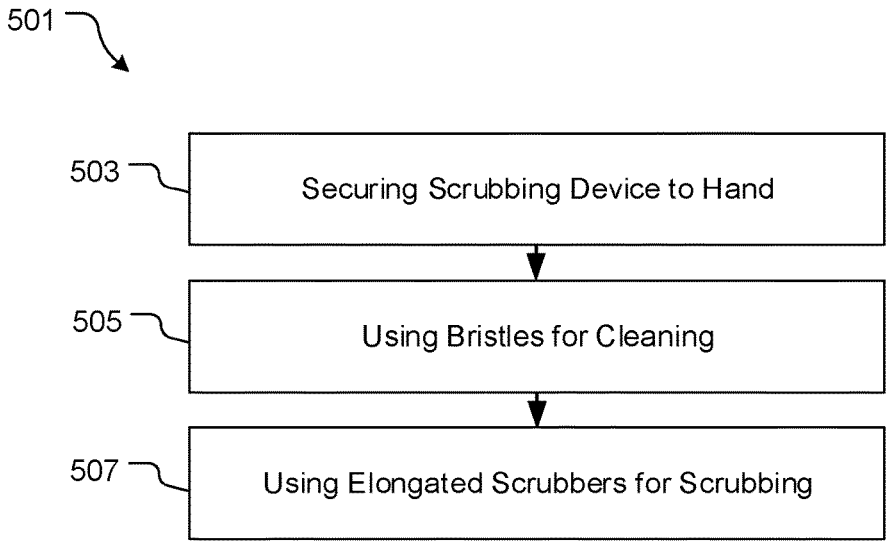
FIG. 5 is a flowchart of the method of use of the device of FIG. 2.

In FIG. 5, a flowchart 501 depicts a method of use of device 201. During use, the user secures the device to their hand via the grip and surface treatment and proceeds to use the bristles and elongated scrubbers for cleaning, as shown with boxes 503, 505, 507.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A scrubbing device, comprising:

a body extending a length from a first end to a second end;

a plurality of bristle protrusions extending from a bottom surface of the body, the plurality of bristles extending two-thirds of the length from the first end to the second end; and a plurality of elongated protrusions forming a triangular cross-section and extending from the bottom surface of the body and forming an angle between each elongated protrusion and the bottom surface, the angle is 45 degrees, the plurality of elongated protrusions extending one-third the length from the first end to the second end, the plurality of elongated protrusions are positioned adjacent to the plurality of bristles;

wherein the plurality of bristle protrusions and plurality of elongated protrusions are used for cleaning.

2. The scrubbing device of claim 1, wherein the body, plurality of bristle protrusions, and plurality of elongated protrusions are composed of silicone.

3. The scrubbing device of claim 1, further comprising:

a handle extending from a top surface of the body.

4. The scrubbing device of claim 1, further comprising:

a surface treatment on a top surface of the body.

* * * * *